US006487779B1

(12) United States Patent
Underthun

(10) Patent No.: US 6,487,779 B1
(45) Date of Patent: Dec. 3, 2002

(54) RECHARGEABLE FILLET KNIFE

(76) Inventor: David A. Underthun, 12049 Louisiana Ave., Champlin, MN (US) 55316

( * ) Notice: Subject to any disclaimer, the term of this patent is extended or adjusted under 35 U.S.C. 154(b) by 0 days.

(21) Appl. No.: 09/907,213

(22) Filed: Jul. 17, 2001

(51) Int. Cl.[7] ..... B26B 7/00

(52) U.S. Cl. ..... 30/277.4; 30/296.1; 30/DIG. 1; 320/2

(58) Field of Search ..... 30/277.4, 340, 30/296.1, DIG. 1; 320/2

(56) References Cited

U.S. PATENT DOCUMENTS 3,329,881 A * 7/1967 Tolmie
3,711,679 A * 1/1973 Moschkau et al.
4,054,994 A * 10/1977 Grossman ..... 30/296.1
4,164,813 A 8/1979 Dittert et al.
4,616,169 A * 10/1986 Proffitt ..... 320/2
4,711,030 A 12/1987 Ruston, Sr.
5,165,488 A * 11/1992 Liu ..... 30/277.4
5,630,750 A 5/1997 Byrd
5,778,541 A * 7/1998 McClung ..... 30/277.4
5,973,294 A * 10/1999 Schatt et al. ..... 30/140
6,341,425 B1 * 1/2002 Kahle ..... 30/277.4

* cited by examiner

*Primary Examiner*—Hwei-Slu Payer
(74) *Attorney, Agent, or Firm*—Dale J. Ream

(57) ABSTRACT

A rechargeable fillet knife comprises a tubular handle defining an interior cavity having front and rear portions. A reciprocating motor is disposed in the front portion of the interior cavity with a pair of blades coupled to the motor. A rechargeable battery is disposed within the rear portion of the interior cavity and is selectably removable therefrom. The battery and motor are electrically coupled to a trigger such that the motor is energized upon a user depression of the trigger. A male connector is electrically coupled to the battery and is configured to selectively mate with a socket. The socket is electrically connected to a connector assembly configured for insertion into a vehicle power receptacle or to a connector assembly configured for insertion into a wall outlet so as to provide electrical power to the battery. The battery may also be removed and inserted into a recharging unit.

18 Claims, 5 Drawing Sheets

RECHARGEABLE FILLET KNIFE

BACKGROUND OF THE INVENTION

This invention relates generally to electric knives and, more particularly, to a rechargeable fillet knife operable using a battery that is rechargeable using a vehicle's cigarette lighter, conventional household current, or a separate battery recharging unit.

Electric carving knives powered by household electrical current are commonly used by consumers for slicing baked meats such as turkey, roast beef, ham, and the like. Similar knives are also used to fillet fish although these knives are often needed at locations where household electrical current is not available.

Various fillet knives and battery recharging units have been proposed in the art. Although assumably effective for their intended purposes, existing devices do not provide a fillet knife powered by a battery that is selectively rechargeable while coupled to or removed from the knife and that is also selectively rechargeable using a vehicle or household power source.

Therefore, it is desirable to have a fillet knife having a battery that is rechargeable while coupled to the fillet knife handle or while removed therefrom. Further, it is desirable to have a fillet knife having a battery which may be recharged through electrical connection with a vehicle or a household electrical power source. Finally, it is desirable to have a fillet knife having a battery that may be recharged through direct connection with a vehicle's cigarette lighter.

SUMMARY OF THE INVENTION

A rechargeable fillet knife according to the present invention includes a tubular handle defining an interior cavity having front and rear portions and defining an opening at a rear end thereof which exposes the rear portion. A reciprocating motor is positioned within the front portion of the handle with a pair of blades removably coupled to the motor and extending forwardly from the handle. The blades are adapted therefore to reciprocate when the motor is energized. The invention further includes a rechargeable battery having a neck formed for insertion into the rear portion of the interior cavity of the handle, the neck having first and second contacts that provide for electrical connection of the battery and reciprocating motor. The battery also includes a flanged end adapted to snappably engage the rear opening of the handle.

A trigger assembly is mounted on the handle which includes a trigger that is electrically connected to the battery and to the reciprocating motor with wires. The trigger is movable between released and depressed positions, the motor being energized at the depressed position.

A male connector is electrically coupled to the battery nd extends from the flanged end thereof. The invention further includes a socket configured to selectably mate with the male connector. An electrical connector assembly is electrically connected to the socket and adapted for connection with an electrical power source for recharging the battery when the male connector is coupled to the socket. The electrical connector may either be a tubular casing adapted for insertion into a vehicle electrical power source such as a cigarette lighter receptacle or an electrical plug adapted for insertion into a wall outlet. Of course, the battery may be snappably removed from the handle and recharged by inserting the neck directly into the cigarette lighter receptacle.

The rechargeable fillet knife further includes a recharging unit having a tubular receptacle for receiving the neck of the battery. The tubular receptacle is coupled to either a plug for insertion into a wall outlet or to a tubular casing adapted for insertion into a vehicle cigarette lighter.

Therefore, a general object of this invention is to provide a rechargeable fillet knife that may be utilized in remote locations.

Another object of this invention is to provide a rechargeable fillet knife, as aforesaid, that may be recharged directly and conveniently utilizing a vehicle cigarette lighter receptacle.

Still another object of this invention is to provide a rechargeable fillet knife, as aforesaid, having a battery that may be recharged while mounted in the fillet knife handle utilizing a vehicle cigarette lighter receptacle.

Yet another object of this invention is to provide a rechargeable fillet knife, as aforesaid, having a battery that may be recharged while mounted in the fillet knife handle utilizing a conventional wall outlet.

A further object of this invention is to provide a rechargeable fillet knife, as aforesaid, having a battery that may be recharged upon removal from the fillet knife handle utilizing a separate recharging unit connected to a vehicle cigarette lighter receptacle.

A still further object of this invention is to provide a rechargeable fillet knife, as aforesaid, having a battery that may be recharged upon removal from the fillet knife handle utilizing a separate recharging unit connected to a conventional wall outlet.

A particular object of this invention is to provide a rechargeable fillet knife, as aforesaid, having an ergonomic handle that is lightweight and easy to grip and maneuver.

A further object of this invention is to provide a rechargeable fillet knife, as aforesaid, having removable and interchangeable reciprocating blades.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
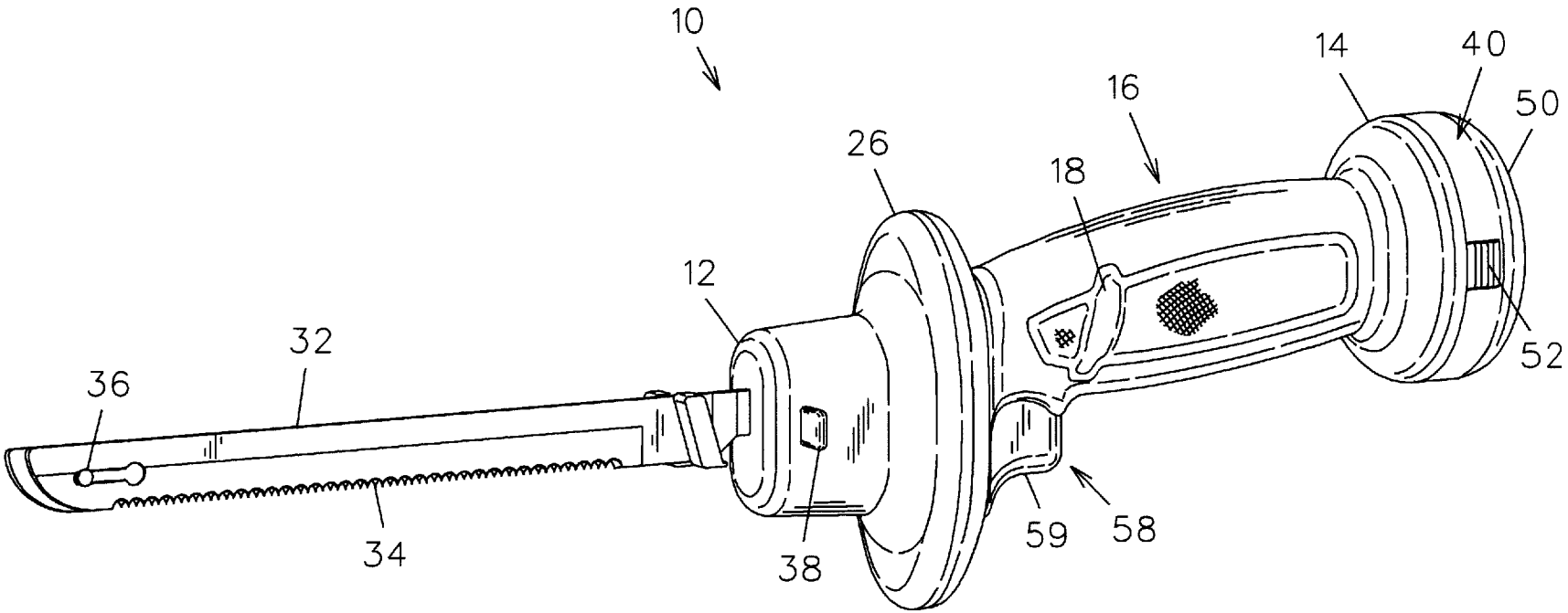
FIG. 1 is a perspective view of a rechargeable fillet knife according to the preferred embodiment of the present invention.
Figure 2:
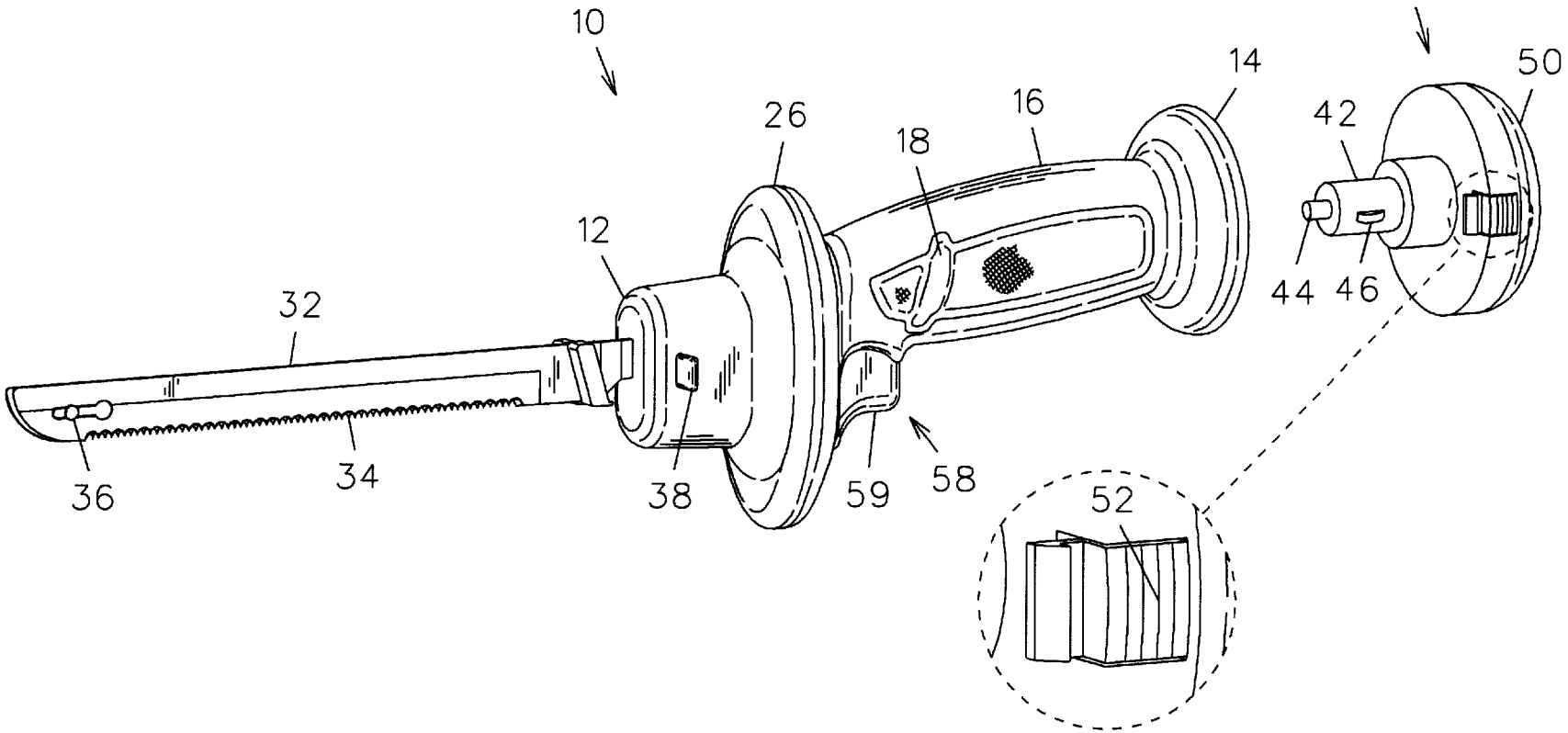
FIG. 2 is a perspective view of the fillet knife as in FIG. 1 with the battery removed and with an isolated view of the battery clasp on an enlarged scale.
Figure 3:
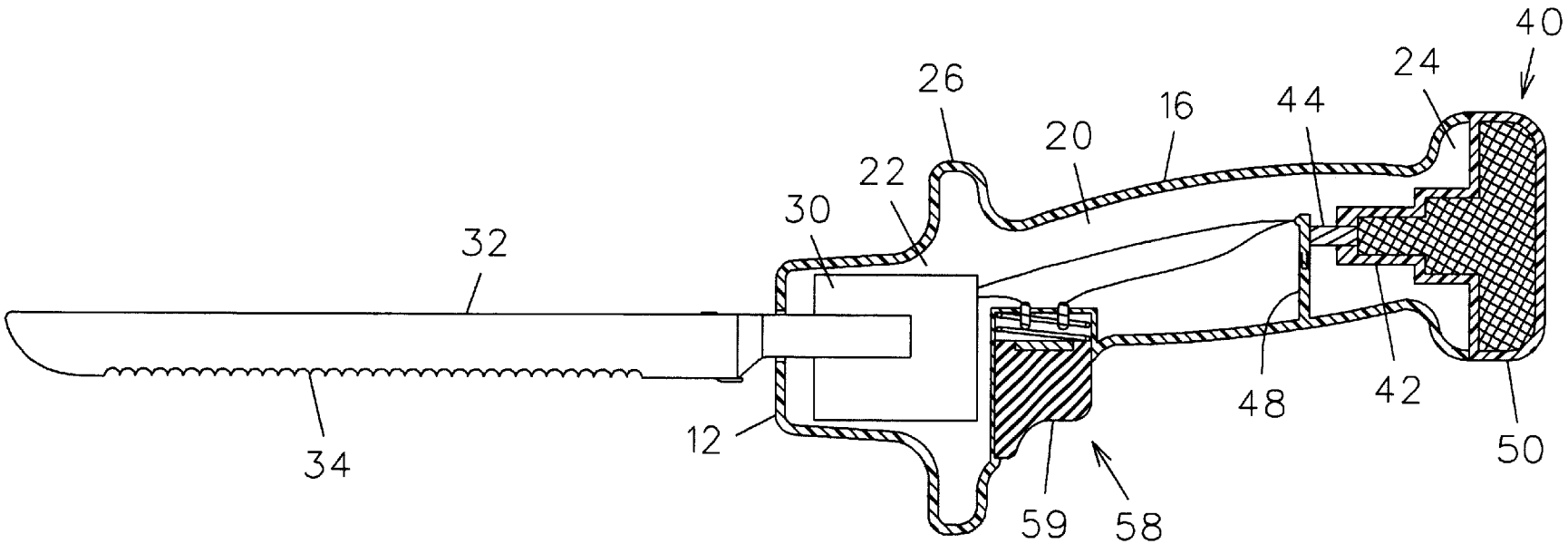
FIG. 3 is a sectional view of the fillet knife taken along line 3—3 of FIG. 4*a;*

A rechargeable fillet knife 10 according to a preferred embodiment of the present invention will now be described with reference to FIGS. 1 through 5*b* of the accompanying drawings. The fillet knife 10 includes an elongate tubular handle 16 having front 12 and rear 14 ends and defining an interior cavity 20 (FIGS. 1 and 3). The interior cavity 20 further includes front 22 and rear 24 portions. The handle 16 is ergonomically configured and is constructed of a durable plastic material. The handle 16 further includes a soft touch plastic material about the portion where a user grips the handle such that the handle 16 is easy and comfortable to hold and maneuver. A pair of outwardly tapered support flanges 18 are integrally formed on opposite sides of the handle 16 intermediate the front 12 and rear 14 ends which properly position and orient a user's thumb and forefinger when gripping the handle 16 (FIGS. 1 and 4).

A reciprocating motor and gear assembly 30 is positioned within the front portion 22 of the interior cavity 20 of the handle 16 (FIG. 3). A pair of blades 32 having serrated edges 34 are removably coupled to the motor 30 and extend through an opening in the front wall of the handle 16 in juxtaposed relation relative to one another (FIG. 1). The longitudinal alignment of the blades 32 may be selectably offset by repositioning a selector bar 36. The blades 32 may be released upon depression of a release actuator 38 positioned at the front end 12 of the handle 16 such that the blades 32 may be replaced or interchanged with blades having a another configuration.

The handle 16 forms a disk-shaped portion 26 spaced from the front end 12 and configured so as to shield the hand of a user gripping the handle 16 from the blades 32 which extend from the front end 12 of the handle 16. The rear end 14 of the handle 16 defines a circular opening which exposes the rear portion 24 of the interior cavity 20.

The fillet knife 10 further includes a rechargeable battery 40 having a cylindrical neck 42 that may be inserted into the rear portion 24 of the interior cavity 20. The neck 42 includes a first contact 44 at an operative end and a second contact 46 on a side thereof, the first contact 44 being in electrical contact with a post 48 mounted within the rear portion 24 when the battery is inserted in the rear portion (FIG. 3). It should be appreciated that the neck 42 is formed to a shape corresponding to a conventional vehicle cigarette lighter receptacle and may be inserted therein for direct recharging. Preferably, the battery 40 is a high capacity nickel cadmium battery. The battery 40 further includes a flanged end 50 having a circular configuration configured to cover the rear opening of the handle 16. The flanged end 50 includes a clasp 52 configured to snappably couple the battery 40 to the handle 16, the battery 40 being removable therefrom upon a user operation of the clasp 52 (FIG. 2).

A trigger assembly 58 is mounted to the handle 16 rearwardly adjacent the shield 26 and includes a trigger 59 that is slidably movable between released and depressed configurations. The trigger 59 is slidably moved into the interior cavity 20 when it is depressed by a user. The trigger 59 is electrically connected to the post 48 and to the motor 30 with wires and completes a circuit between the battery 40 and motor 30 when the trigger 59 is fully depressed, thus energizing the motor 30 (FIG. 3).

Figures 4A, 4B, 4C:
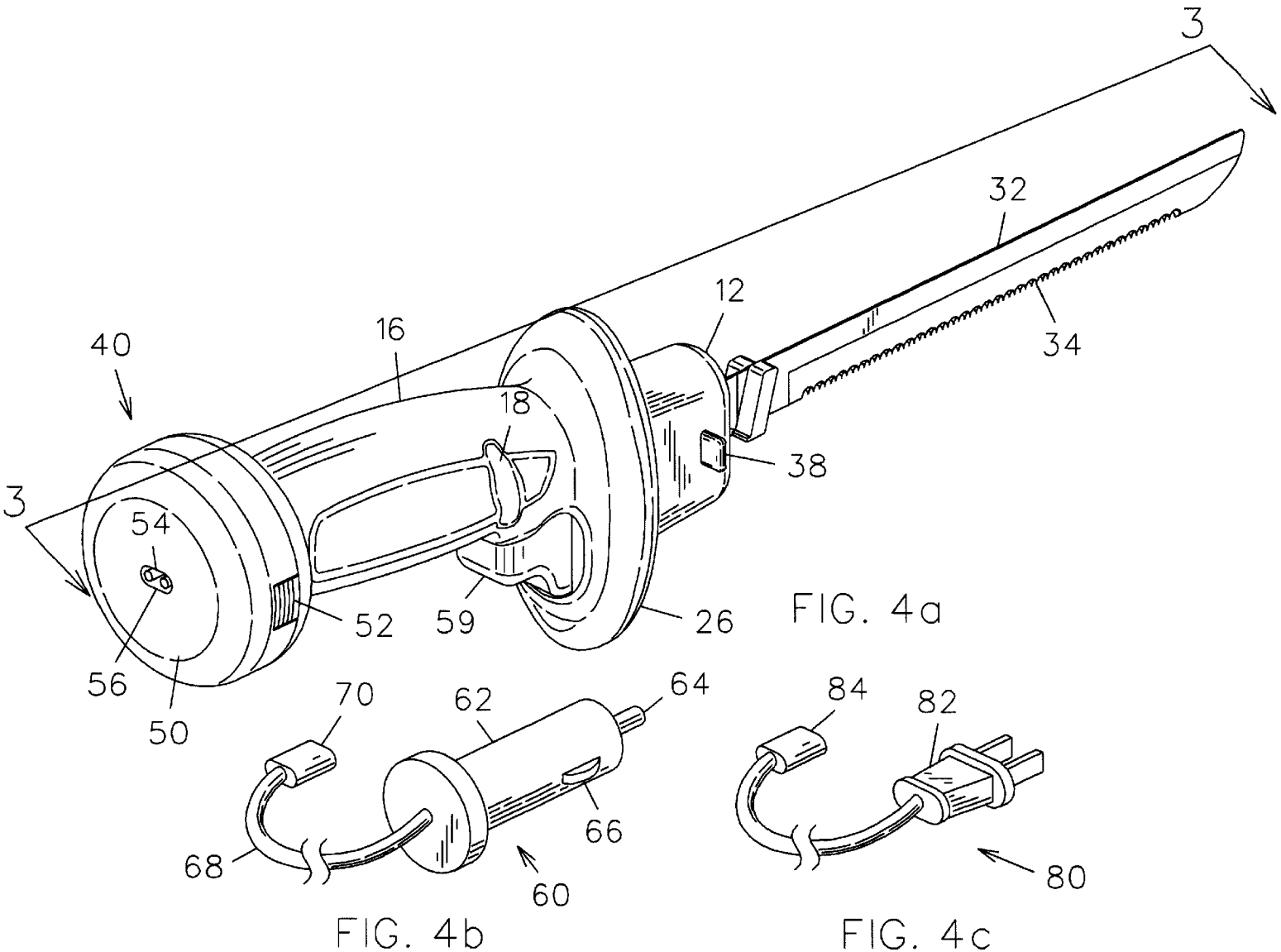
FIG. 4*a* is a reverse perspective view of the fillet knife as in FIG. 1.
FIG. 4*b* is a perspective view of an electrical connector assembly according to the present invention.
FIG. 4*c* is a perspective view of another electrical connector assembly according to the present invention.

A pair of electrical contact members are electrically connected to the battery 40 to form a male connector 54 which extends into a recess 56 formed in the flanged end 50 of the battery 40 to facilitate recharging of the battery 40 while still mounted in the handle 16, as to be described below (FIG. 4*a*). A first electrical adapter/connector assembly 60 includes a tubular casing 62 suitable for insertion into a vehicle cigarette lighter receptacle (FIG. 4*b*). A positive contact member 64 extends from a free end of the casing 62. A negative contact member 66 in the form of an arcuate spring protrudes laterally outwardly from one side of the casing 62. An arcuate retention spring (not shown) may also protrude from an opposing side of the casing 62. An electrical cord 68 connects the casing 62 with a socket 70, the socket 70 being adapted to selectively mate with the male connector 54 of the flanged end 50 for electrically connecting the socket 70 with a cigarette lighter receptacle of a vehicle when the casing is inserted in the receptacle. Therefore, the battery 40 may be recharged when the first electrical adapter/connector assembly 60 is utilized to connect the battery 40 to a vehicle power source.

A second electrical adapter/connector assembly 80 includes an electrical connector plug 82 suitable for insertion in a conventional AC wall outlet (FIG. 4*c*). The connector plug 82 is connected to a socket 84, the socket 84 being adapted to selectively mate with the male connector 54 of the flanged end 50 for electrically connecting the socket 84 with a wall outlet. Therefore, the battery 40 may be recharged by utilizing the second adapter/connector assembly 80 to connect the battery 40 with a household wall outlet.

Figure 5B:
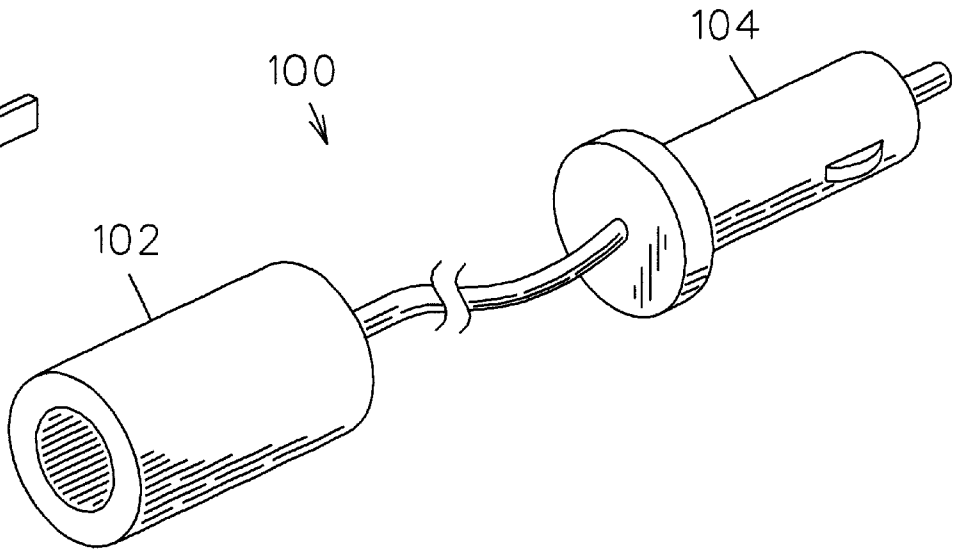
FIG. 5*b* is a perspective view of another recharging unit according to the present invention.
Figure 5A:
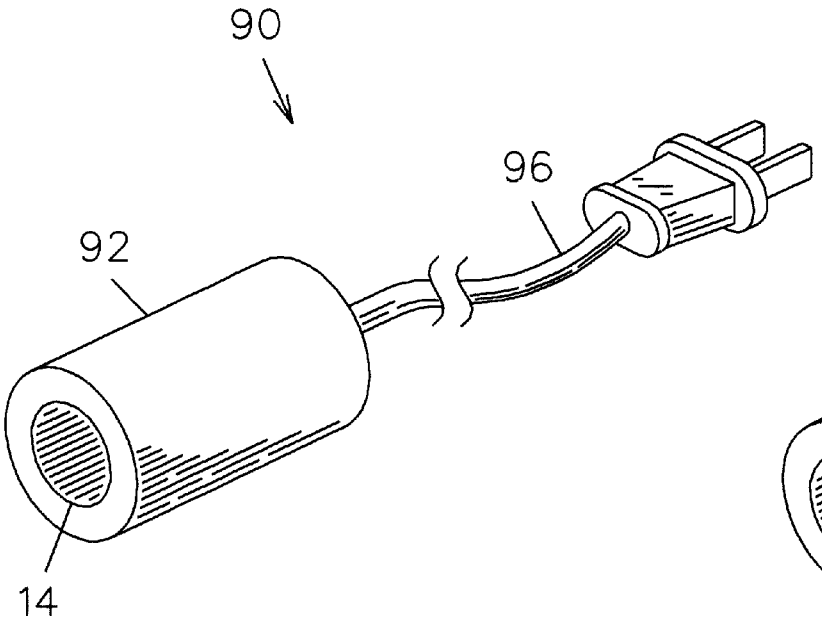
FIG. 5*a* is a perspective view of a recharging unit according to the present invention.

As shown in FIGS. 5*a* and 5*b*, a pair of recharging units are also provided for recharging the battery 40 in or out of a vehicle when the battery is removed from the handle 16. A first recharging unit 90 includes a tubular encasement 92 defining a lumen 94. The lumen 94 is formed so as to receive the neck 42 of the rechargeable battery 40 and includes a pair of electrical contacts therein (not shown) which mate with the first contact 44 and second contact 46 of the battery neck 42. An electrical power cord 96 is connected to the encasement 92 for providing electrical power to the first recharging unit 90 from a wall outlet.

A second recharging unit 100 includes a tubular 25 encasement 102 having a construction substantially similar to that described relative to the first recharging unit 90. A tubular casing 104 adapted for insertion into a vehicle cigarette lighter is electrically coupled to the encasement 102 for providing electrical power from the vehicle to the second recharging unit 100. The casing 104 of the second recharging unit 100 has a construction substantially similar to the casing 62 described previously relative to the first adapter/connector assembly 60.

In use, a user may recharge the rechargeable battery 40 in several ways, as desired or depending on the electrical power sources that are available. First, a user may remove the battery 40 from the ergonomic handle 16 by operating the clasp 52 and may then insert the neck 42 directly into a vehicle cigarette lighter receptacle for recharging. When sufficiently recharged, the battery 40 may be reinserted into the handle 16 and snappably secured therein. Second, the male connector 54 may be mated with the socket 70 of the first connector assembly 60 and the casing 62 thereof may then be inserted into a vehicle cigarette lighter receptacle. Or, the male connector 54 may be mated with the socket 84 of the second connector assembly 80 and the connector plug 82 thereof may then be inserted into a conventional wall outlet. Third, the user may remove the battery 40 from the handle 16 and insert the battery neck 42 into the lumen 94 of the first 90 or second 100 recharging unit which may then be connected to a wall outlet or cigarette lighter, respectively. With a recharged battery 40 inserted in the handle 16, a user may depress the trigger 59 to complete the circuit between the motor 30 and battery post 48, thus energizing the motor 30. This causes the blades to reciprocate relative to one another and the user may manipulate the handle 16 to perform desired cutting operations.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A rechargeable fillet knife, comprising:

an elongate tubular handle having front and rear ends and defining an interior cavity having a front portion and a rear portion, said handle defining an opening at said rear end in communication with said rear portion of said interior cavity;

a reciprocating motor disposed in said front portion of said handle;

a pair of blades removably coupled to said reciprocating motor and extending from said front end of said handle;

a rechargeable battery comprising:

a neck formed for insertion into said rear portion of said interior cavity of said handle and including at least a first contact and a second contact that provide for electrical connection of said battery to said reciprocating motor;

a flanged end opposite said neck adapted to removably engage said opening at said rear end of said handle;

a male connector electrically coupled to said battery and extending through said flanged end thereof;

a socket for selectably mating with said male connector;

an electrical connector assembly electrically connected to said socket for electrically connecting said socket with an electrical power source for recharging said battery when said male connector is coupled to said socket;

a trigger assembly having a trigger coupled to said handle that is electrically connected to said rechargeable battery and to said reciprocating motor, said trigger being movable between a released configuration and a depressed configuration such that said reciprocating motor is energized at said depressed configuration; and a first recharging unit having a tubular receptacle adapted for receiving said neck of said battery, and an electrical power cord electrically connected to said receptacle for providing electrical power to said recharging unit from a wall outlet.

2. The rechargeable fillet knife as in claim 1 wherein said handle includes a pair of outwardly tapered support surfaces mounted on opposed sides of said handle intermediate said front and rear ends, said pair of tapered support surfaces being configured so as to properly orient a user's thumb and forefinger relative to said trigger when grasping said handle.

3. The rechargeable fillet knife as in claim 1 wherein said electrical connector assembly comprises:

a tubular casing adapted for insertion into an electrical receptacle in a vehicle, said casing having a positive contact member extending from an operative end thereof and a negative contact member extending from a side thereof; and a wire conductor extending from an opposite end of said casing and coupled to said socket for electrically connecting said socket with said electrical receptacle when said casing is inserted therein.

4. The rechargeable fillet knife as in claim 1 wherein said electrical connector assembly comprises:

an electrical connector plug adapted for insertion into an electrical wall outlet; and a wire conductor extending from said plug and coupled to said socket for electrically connecting said socket with said wall outlet when said plug is inserted therein.

5. The rechargeable fillet knife as in claim 1 wherein said flanged end of said battery engages said opening in a snap-fit relationship.

6. The rechargeable fillet knife as in claim 1 comprising a second recharging unit having a tubular receptacle adapted for receiving said neck of said battery, and a tubular casing electrically connected to said second recharging unit with an electrical cord, said casing adapted for insertion into an electrical receptacle of a vehicle for providing electrical power from said vehicle to said second recharging unit.

7. A rechargeable fillet knife, comprising:

a tubular handle having front and rear ends and defining an interior cavity having a front portion and a rear portion, said handle defining an opening at said rear end exposing said rear portion of said interior cavity;

reciprocating means disposed in said front portion of said handle;

a pair of blades attached to said reciprocating means;

a rechargeable battery positioned within said rear portion of said interior cavity of said handle and electrically connected to said reciprocating means;

a male connector electrically coupled to said battery and extending through said opening at said rear end of said handle;

a socket for selectably mating with said male connector;

means for electrically connecting said socket with an electrical power source for recharging said battery when said male connector is coupled to said socket, wherein said connecting means comprises:

a tubular casing adapted for insertion into an electrical receptacle in a vehicle, said casing having a positive contact member extending from an operative end thereof and a negative contact member extending from a side thereof; and a wire conductor extending from an opposite end of said casing and coupled to said socket for electrically connecting said socket with said electrical receptacle when said casing is inserted therein; and means on said handle for actuating said reciprocating means.

8. The rechargeable fillet knife as in claim 7 wherein said actuating means includes a trigger electrically connected to said battery and said reciprocating means, said trigger being movable between a released configuration in which said battery and said reciprocating means are not electrically connected and a depressed configuration in which said battery and said reciprocating means are electrically connected and said reciprocating means is energized.

9. The rechargeable fillet knife as in claim 7 wherein said handle includes a pair of outwardly tapered support surfaces mounted on opposed sides of said handle intermediate said front and rear ends, said pair of tapered support surfaces being configured so as to properly orient a user's thumb and forefinger relative to said trigger when grasping said handle.

10. The rechargeable fillet knife as in claim 7 wherein said electrical connecting means comprises:

an electrical connector plug adapted for insertion into an electrical wall outlet; and a wire conductor extending from said plug and coupled to said socket for electrically connecting said socket with said wall outlet when said plug is inserted therein.

11. The rechargeable fillet knife as in claim 7 wherein said battery comprises:

a neck formed for insertion into said rear portion of said interior cavity of said handle and including at cast a first contact and a second contact that provide for electrical connection of said battery to said reciprocating means; and a flanged end opposite said neck adapted to removably engage said opening at said rear end of said handle in a snap-fit configuration.

12. The rechargeable fillet knife as in claim 11 comprising a recharging unit having a tubular receptacle for receiving said neck of said battery and an electrical power cord electrically connected to said receptacle for providing electrical power to said recharging unit from a wall outlet.

13. The rechargeable fillet knife as in claim 11 comprising a recharging unit having a tubular receptacle for receiving said neck of said battery and a tubular casing electrically connected to said recharging unit with an electrical cord, said casing adapted for insertion into an electrical receptacle of a vehicle for providing electrical power from said vehicle to said recharging unit.

14. A rechargeable fillet knife, comprising:

an elongate tubular handle having front and rear ends and defining an interior cavity having a front portion and a rear portion, said handle defining an opening at said rear end in communication with said rear portion of said interior cavity;

a reciprocating motor disposed in said front portion of said handle;

a pair of blades removably coupled to said reciprocating motor and extending from said front end of said handle;

a rechargeable battery comprising:

a neck formed for insertion into said rear portion of said interior cavity of said handle and including at least a first contact and a second contact that provide for electrical connection of said battery to said reciprocating motor;

a flanged end opposite said neck adapted to removably engage said opening at said rear end of said handle;

a trigger assembly having a trigger coupled to said handle that is electrically connected to said rechargeable battery and to said reciprocating motor, said trigger being movable between a released configuration and a depressed configuration such that said reciprocating motor is energized at said depressed configuration;

a recharging unit having a tubular receptacle for removably receiving said neck of said battery;

means electrically connected to said recharging unit for providing electrical power to said recharging unit for recharging said battery when said neck is inserted in said receptacle.

15. The rechargeable fillet knife as in claim 14 further comprising:

a male connector electrically coupled to said battery and extending through said opening at said rear end of said handle;

a socket for selectably mating with said male connector;

an electrical connector having a tubular casing for insertion into an electrical receptacle in a vehicle, said casing having a positive contact member extending from an operative end thereof and a negative contact member extending from a side thereof; and a wire conductor extending from an opposite end of said casing and coupled to said socket for electrically connecting said socket with said electrical receptacle when said casing is inserted therein.

16. The rechargeable fillet knife as in claim 14 further comprising:

a male connector electrically coupled to said battery and extending through said opening at said rear end of said handle;

a socket for selectably mating with said male connector;

an electrical connector plug adapted for insertion into an electrical wall outlet; and a wire conductor extending from said plug and coupled to said socket for electrically connecting said socket with said wall outlet when said plug is inserted therein.

17. The rechargeable fillet knife as in claim 14 wherein said means for providing electrical power to said recharging unit includes an electrical power cord electrically connected to said recharging unit and adapted to provide electrical power thereto from a wall outlet.

18. The rechargeable fillet knife as in claim 14 wherein said means for providing electrical power to said recharging unit includes a tubular casing electrically connected to said recharging unit with an electrical cord, said casing adapted for insertion into an electrical receptacle of a vehicle for providing electrical power from said vehicle to said recharging unit.

* * * * *